US005628218A

United States Patent [19]

Yamada et al.

[11] Patent Number: 5,628,218

[45] Date of Patent: May 13, 1997

[54] FLAW TREATMENT METHOD AND APPARATUS FOR A WIRE-SHAPED METAL

[75] Inventors: Akinobu Yamada; Toshiyuki Furutani; Norihiro Oda, all of Shin Minato, Japan

[73] Assignee: Nippon Koshuha Steel Co., Ltd., Tokyo, Japan

[21] Appl. No.: 306,819

[22] Filed: Sep. 15, 1994

[30] Foreign Application Priority Data

Mar. 4, 1994 [JP] Japan ..... 6-059886

[51] Int. Cl.[6] ..... B21C 1/02

[52] U.S. Cl. ..... 72/16.2; 72/18.1; 72/31.04; 72/44; 72/275; 72/289

[58] Field of Search ..... 72/275, 280, 289, 72/10, 44, 45, 18.1, 16.2, 15.3, 31.04; 409/298

[56] References Cited

U.S. PATENT DOCUMENTS

| | | | |
|---|---|---|---|
| 2,581,708 | 1/1952 | Rogers | 72/45 |
| 4,291,600 | 9/1981 | Kawaguchi | 82/20 |
| 4,545,227 | 10/1985 | Sudoh | 72/12 |
| 4,799,300 | 1/1989 | Phillips | 72/275 |
| 4,808,926 | 2/1989 | Graham | 72/10 |
| 5,016,475 | 5/1991 | Aburatani | 73/644 |

FOREIGN PATENT DOCUMENTS

| | | | |
|---|---|---|---|
| 110419 | 6/1984 | Japan | 72/275 |

*Primary Examiner*—Daniel C. Crane

*Attorney, Agent, or Firm*—Lackenbach Siegel Marzullo Aronson and Greenspan, P.C.

[57] ABSTRACT

This flaw-treatment apparatus is able to prevent an increase in the number of flaw cuts by detecting false flaw-detection, and prevent the occurrence of die marks. For attaining these effects, this apparatus is comprised of: detection of the surface flaws of the wire-shaped metal by applying a flaw-detecting device, cutting and removal of the detected flaws by applying a flaw-cutting device, drawing of the flaw-free wire-shaped metal by applying a drawing device, spraying of lubricant on the wire-shaped metal, and removal of excess lubricant together with dust, and further grinding of the flaw-cut portion of the wire-shaped metal for obtaining adequate surface roughness before grinding.

5 Claims, 2 Drawing Sheets

FLAW TREATMENT METHOD AND APPARATUS FOR A WIRE-SHAPED METAL

BACKGROUND OF THE INVENTION

This invention relates to a method and apparatus for treating flaws existing on the surface of wire-shaped metals such as bearing steel and stainless or the like.

Up to the present, the following methods for treating flaws existing on the surface of wire-shaped wires such as bearing steel and stainless steel have been used:

(a) Peeling all surfaces of wire-shaped metals by applying chipping dyes;

(b) Peeling all surfaces of wire-shaped metals by using a centerless peeling machine;

(c) Grinding the flawed portions by using a hand grinder after visually detecting the flaws;

(d) Grinding marked portions after detection of the flawed portions along the entire length of a wire-shaped metal by an automatic flaw-detecting device and marking of the flawed portions with paint.

However, there are costly drawbacks in methods like (a) and (b) above, such as yield rate dropping and early wearing of the peeling tool. Although methods (c) or (d) remarkably improve the yield rate of the product by peeling only the portions to be removed, they require unbinding of the wire-shaped metal, and visual detection of the flaws along the entire length and all peripheries, or visual detection of the paint-marked portion around the periphery.

Consequently, these methods are difficult to work, inadequate and incur remarkably high labor costs.

It is also known that flaws on the surface of spiral wires, straight wires and steel rods can be automatically removed by cutting, shaving or grinding off by an automatic flaw-removal method comprising the detection of the existence and location of the circumferential and longitudinal flaws on the surface of wires or steel rods by applying a flaw-detecting device; transmission of flaw information detected by a flaw-detecting device to a distance-computing device and to a flaw-cutting device; detection of the running speed of said wires or rods by applying a running speed detecting device; computation of the distance between said detected flaw position and said flaw-cutting device by applying running speed information received from said running speed detecting device or the distance-computing device; activation of the flaw-cutting device by applying distance information of the wires or rods obtained from the distance-computing device; and cutting said detected flaw by applying the flaw-cutting device. Japanese Patent Publication No. 50453/1984.

When the known method is used for removing flaws on the surface of spiral wires, however, it has another disadvantage to be overcome.

The present invention was developed in consideration of the above-mentioned drawbacks, and its first object is to reduce labor costs, to increase product yield rate, to shorten processing time, and to reduce production costs by automatically cutting only the flawed portions of a wire-shaped metal.

However, in order to remove harmful flaws entirely, the following problems must be resolved.

This process contains both a detecting step which locates flaws along circumferential and longitudinal directions of the wire-shaped metal by application of a flaw-detecting device, and a cutting step which automatically cuts and removes any detected flaws by applying a cutting bite, requiring restoration from the irregularity of the diametric shape of the cut portions. If this restoration step was performed on another work line, productivity dropped and production costs rose.

Also, to increase the working efficiency of wire-shaped metal, it is preferable to perform both flaw-detection and automatic flaw-cutting on the same work line. But if dust attaches to the wire-shaped metal, it is apt to transmit a false flaw-detection signal, increasing the number of cuts and increasing the wear on the cutting bites. Further, the more the surface of the metal is cut, the more unnecessary die markings appear, and the die markings deteriorate the metal quality.

Furthermore, even if flaw-detection and automatic flaw-cutting operations are performed on the same work line as described above, die marks were still apt to be produced owing to insufficient adhesiveness of the lubricant on the cut metallic surface of the wire-shaped metal, in the wire drawing process following automatic flaw removal.

This invention was developed to overcome the above problems, and its second object is to provide a flaw-removal method and apparatus able to increase working efficiency for treatment of a wire-shaped metal, to reduce manufacturing costs, to prevent the increase in the number of cuts owing to a false defect detection and to prevent the appearance of die marks.

SUMMARY OF THE INVENTION

In order to attain the above-mentioned objects, the first embodiment according to this invention in the flaw-treatment method for wire-shaped metal comprises, detection of the existence and location of circumferential and longitudinal flaws on the surface of a wire-shaped metal by application of a flaw-detecting device; transmission of flaw information detected by the flaw-detecting device; detection of the running speed of said wire-shaped metal by applying a running speed-detecting device; computation of the distance between the detected flawed position and a flaw-cutting device by applying running speed information received from the running speed-detecting device or an alternative distance-computing device; activation of the flaw-cutting device by applying distance information obtained from the distance-computing device; cutting of the detected flaw by using the flaw-cutting device; installation of the wire-drawing device in the same working line behind the wire-cutting device; and repair of the irregular sectional shape of the flaw-removed portion by further drawing the wire-shaped metal.

The second embodiment according to the present invention comprises: installation of the first and second dies in series in front of the flaw-detecting device; spraying of lubricant on the wire-shaped metal at the first dies; and, at the second dies, removal of adhered foreign matter such as dust that the flaw-detecting device is apt to misjudge as harmful flaws.

The third embodiment according to the present invention further comprises:

installation of a grinding device on the same working line, placed between the flaw-detecting device and the wire-drawing device; and repair of the irregular shape of the flaw-removed wire-like metal; and drawing of the repaired wire-shaped metal by applying said wire-drawing device for obtaining a sound wire-shaped metal.

The fourth embodiment according to the present invention is the flaw-treatment apparatus adopting the method.

The fifth embodiment according to the present invention is the flaw-treatment apparatus further comprises:

a first dies installed on said working line, said first dies spraying lubricant on said wire-shaped metal; and after the wiring-drawing device, said grinding device roughly surfacing the overly smooth surface of the flaw-cut portion the wire shaped metal.

BRIEF DESCRIPTION OF THE DRAWINGS

The object and features of the present invention will become more readily apparent from the following detailed description taken in conjunction with the accompanying drawings in which.

DETAILED DESCRIPTION OF THE INVENTION

One embodiment according to the present invention is described in detail with reference to the drawings as follows.

Figure 1:
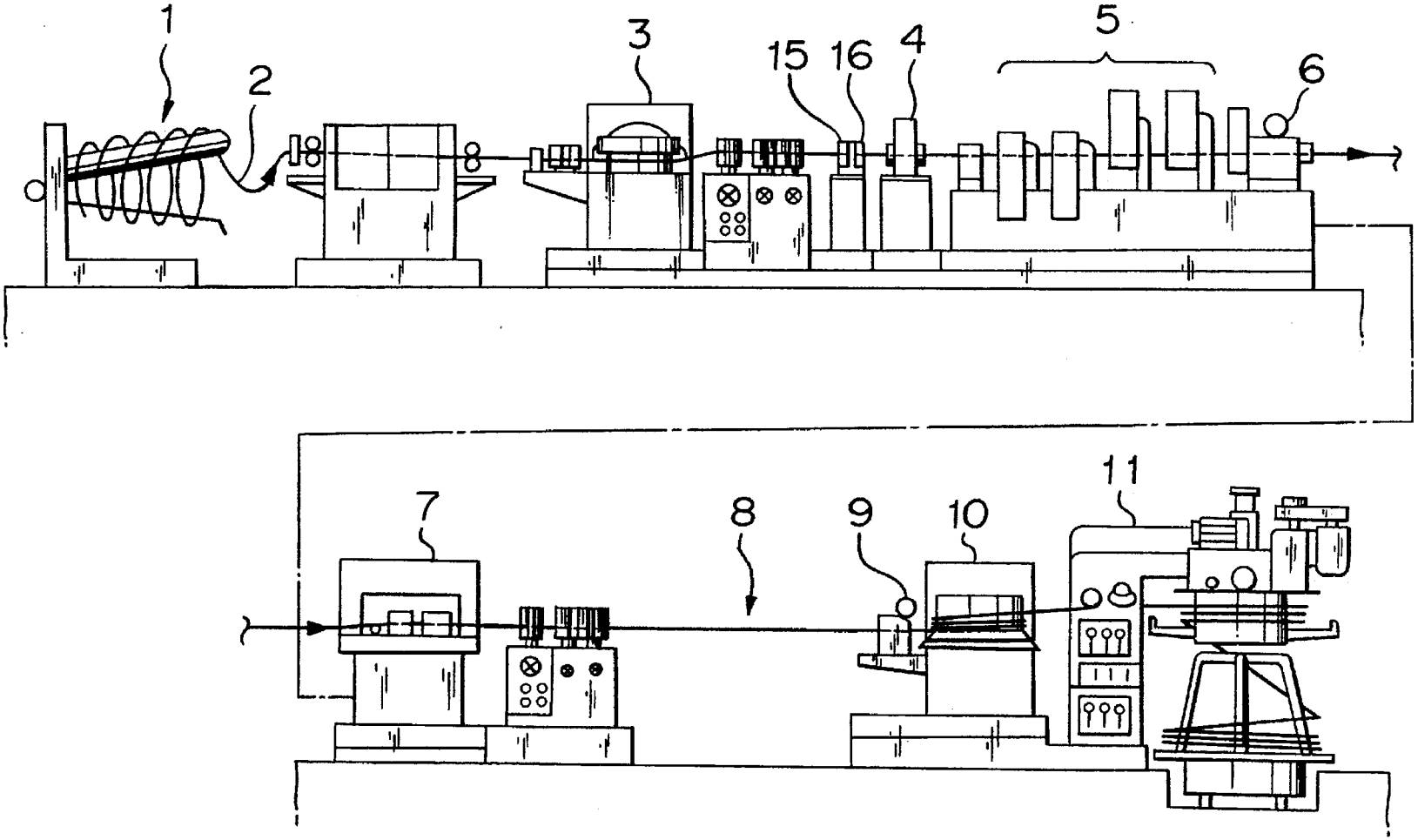
FIG. 1 is a side elevational view showing one embodiment according to the present invention.

In FIG. 1, numeral 1 is a supply stand which supports and supplies a wire-shaped metal 2, numeral 3 is a winding device which winds the wire-shaped metal from the supply stand 2, numeral 4 is a flaw-detecting device for finding the existence and location of circumferential and longitudinal flaws existing on the wire-shaped metal pulled out of the winding device 3, and numeral 5 is a flaw-removal device for cutting detected flaws.

Also in FIG. 1, numeral 6 is drawing dies for drawing the wire-shaped metal, numeral 7 is a wire-drawing device, numeral 8 is a site for visual and manual flaw detection and flaw removal, numeral 9 is another wire-drawing dies, numeral 10 is a wire-drawing device and numeral 11 is a winding device of the drawn wire-shaped metal 2.

Further, numeral 15 is the first dies installed in front of the flaw-detecting device 4 to spray lubricants on the running wire-shaped metal 2, and numeral 16 is the second dies installed on the same working line and placed between the first dies 15 and the flaw-detecting device 4 to remove excess lubricant, oily spots on the surface of the wire and dust adhering to the wire-shaped metal.

Namely, it becomes possible to suppress false flaw-detection signals and to prevent intrusion of adhered materials into the flaw-detecting device by applying the first dies 15 for spraying lubricant on the wire-shaped metal, and applying the second dies 16 for stripping the adhered dust and oily spots on the membrane.

Figure 2:
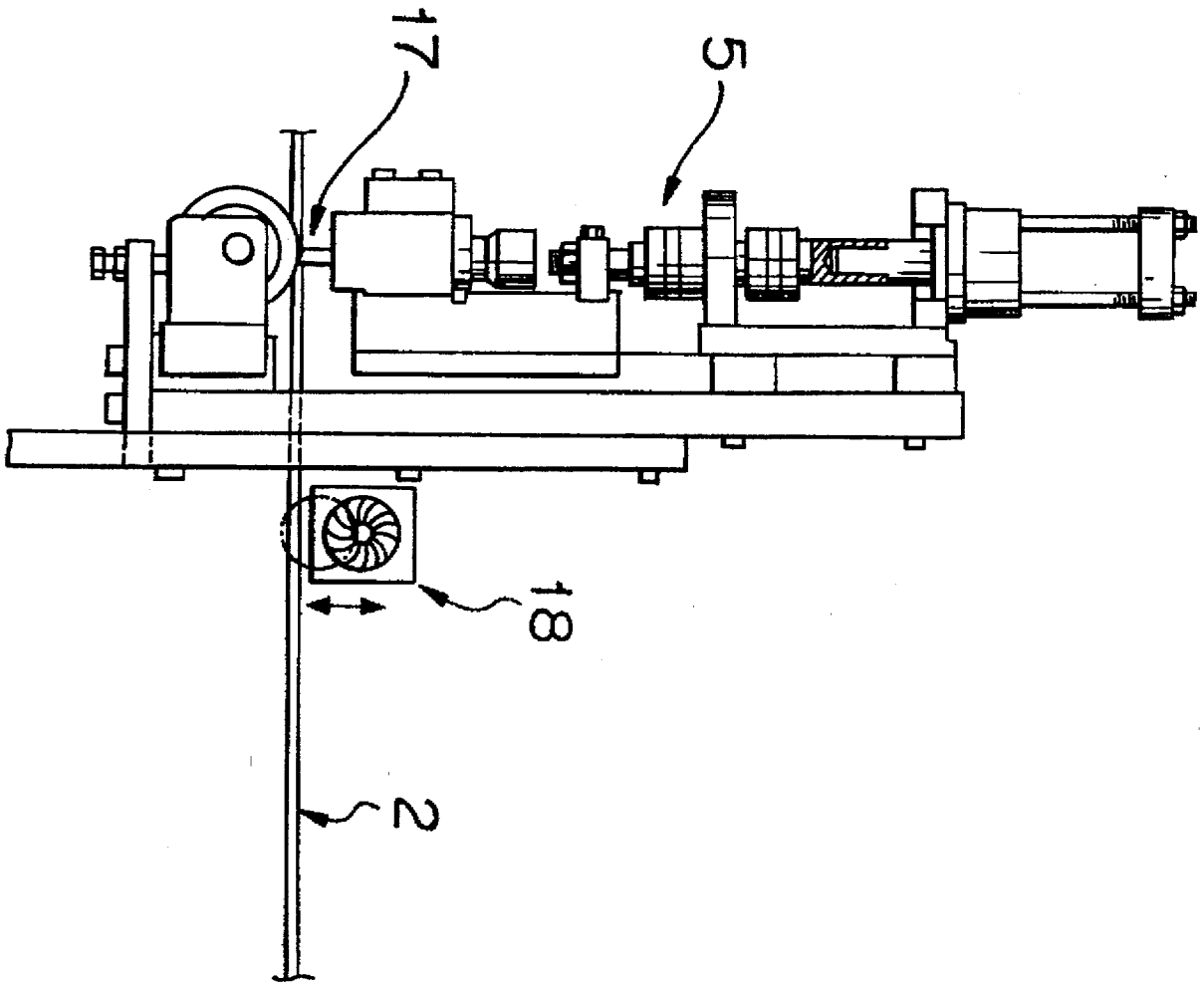
FIG. 2 is a plan view showing the grinding device installed near the flaw-cutting device shown in FIG. 1.

In FIG. 2, showing the flaw-cutting device 5, cutting bites 17 are installed at every angular distance of 90° around the wire-shaped metal, and after this flaw-cutting device 5, a grinding device 18 is installed to grind the surface of the wire-shaped metal to make it more rough.

As the flaw-cut portion of the wire-shaped metal has metallic fine roughness and prevents adhesion of the lubricant in the drawing process following flaw-cutting, the fine roughness causes die marks on the surface of the wire-shaped metal.

Therefore, the grinding device 18 is installed after the flaw-cutting device 5, grinding the flaw-cut surface immediately after flaw-cutting, by being pushed to the surface as shown in FIG. 2.

By applying this process, it becomes possible to draw the flaw-cut wire-shaped metal without dies marks.

The series of work process by using this apparatus according to the present invention is described as follows.

First, the wire-shaped metal 2 placed on the supply stand 1 is wound on the winding device 3, then the flaw-detecting device detects any existing flaws, and if flawed portions are found, automatically removes the detected flaws, resulting in a flawless wire-shaped metal 2.

In this state, in order to repair a deviation in roundness on the flaw-cut portions, the flaw-free wire-shaped metal 2 is drawn between a pair of wire-drawing dies 6, 9 and a pair of wire-drawing devices 7, 10, and finally wound on a winding device 11.

By performing a series of operations in the same line as above-described, it becomes possible to produce sound wire-shaped metals having no harmful flaws and no roundness deviation, while maintaining low production costs.

As described above in detail, this flaw-treatment method and apparatus for wire-shaped metal according to the present invention becomes able to produce the following effects:

increase in working efficiency, decrease in production costs, the prevention of false flaw-detection signals, and the avoidance of die marks owing to the increase of metallic skin, because the method and apparatus are comprised of a series of successive steps. Namely, detection of the surface flaws on the wire-shaped metal by the flaw-detecting device, cutting and removal of the detected flaw portions by the flaw-cutting device, drawing of the flaw-removed metal by the drawing device, stripping of lubricant sprayed on the wire-like metal together with the dust and the oily spots, spoiling of the flaw-removed wire-like metal by the grinding device for the repair of irregular sectional shapes.

What is claimed is:

1. A flaw-treatment method for wire-shaped metal with a flaw-treating apparatus provided with a flaw-cutting device and a drawing device installed on the same work line after the flaw-cutting device, which comprises the steps of:

grinding a wire-shaped metal at a flaw-cut portion to make the portion rough with a grinding device being installed after said flaw-cutting device; and drawing said metal at the flaw-cut portion.

2. A flaw treatment apparatus comprising flaw-detecting means which finds the existence and location of circumferential and longitudinal flaws on the surface of wire-shaped metal;

running speed detector means for finding the running speed of the wire-shaped metal;

distance-computing means as an alternative to said running speed detector means;

flaw-cutting means for cutting said flaw-detected portion by applying flaw information received from said flaw-detecting means and running speed information obtained from said running speed detector means or the distance run information derived from said distance-computing means;

wire-drawings means installed on the same working line in series and placed after said flaw-detecting means and said flaw-cutting means, said drawing means drawing said flaw-free wire-shaped metal so as to repair the irregular shape of said wire-shaped metal; and grinding means installed on said working line and placed after said wire-drawing device for grinding the skin of said flaw-cut portion of said wire-shaped metal.

3. A flaw-treatment method for wire-shaped metal comprising the steps of detecting the flaw and its position along peripheral and longitudinal directions of a wire-shaped metal by application of a flaw-detecting device;

collecting flaw information detected by said detecting device;

detecting a running speed of said wire-shaped metal by applying a running speed detecting device;

detecting the distance to a flaw-cutting device from the detected flaw position by applying a distance-computing device;

activating said flaw-cutting device by combining flaw information derived from said flaw-detecting device with distance run information derived from said distance-computing device;

removing said detected flaws by said flaw-cutting device;

repairing the irregular portion resulting from flaw-cutting by drawing said wire-shaped metal by use of a drawing device installed on the same work line and placed after said flaw-cutting device;

installing first and second dies in series in front of said flaw-detecting device;

spraying of lubricant on said wire-shaped metal at said first die;

removing at the second die adhered impurities such as dust that the flaw-detecting device is apt to judge as flaws;

installing a grinding device between said flaw-cutting device and said wire-drawing device in the same work line;

repairing the irregularity in shape of said flaw-cut portion of said wire-shaped metal by applying said grinding device; and drawing of the repaired wire-shaped metal by said wire-drawing device.

4. A flaw treatment apparatus provided with a flaw-cutting device and a drawing device installed on the same work line and after the flaw-cutting device, said flaw-treating apparatus being equipped at least with a flaw-detecting device which finds the existence and location of circumferential and longitudinal flaws on the surface of wire-shaped metal;

running speed detector which finds the running speed of the wire-shaped metal;

distance-computing device as an alternative to said running speed detector; and flaw-cutting device by which said flaw-detected portion is cut on the basis of flaw information received from said flaw-detecting means and running speed information obtained from said running speed detector or the distance run information derived from said distance-computing device;

a first die installed on said working line for spraying lubricant on said passing wire-shaped metal;

a second die installed on said working line placed after said first die for stripping excess lubricant, oily spots on the wire-shaped metal and adhered dust; and a grinding device is installed on the same working line after the flaw-cutting device.

5. A flaw treatment apparatus comprising flaw-detecting means which finds the existence and location of circumferential and longitudinal flaws on the surface of wire-shaped metal;

running speed detector means for finding the running speed of the wire-shaped metal;

distance-computing means as an alternative to said running speed detector means;

flaw-cutting means for cutting said flaw-detected portion by applying flaw information received from said flaw-detecting means and running speed information obtained from said running speed detector means or the distance run information derived from said distance-computing means;

wire-drawings means installed on the same working line in series and placed after said flaw-detecting means and said flaw-cutting means, said drawing means drawing said flaw-free wire-shaped metal so as to repair the irregular shape of said wire-shaped metal;

grinding means installed on said working line and placed after said wire-drawing device for grinding the skin of said flaw-cut portion of said wire-shaped metal; and first die installed on said working line, said first die spraying lubricant on said passing wire-shaped metal; and a second die installed on said working line placed after said first die, said second die stripping excess lubricant, the undesired oily spots on the wore-shaped metal and adhered dusts.

* * * * *